US007629944B2

(12) United States Patent
Lenart et al.

(10) Patent No.: US 7,629,944 B2
(45) Date of Patent: Dec. 8, 2009

(54) ANTENNA COMPROMISING A CONNECTOR ASSEMBLY

(75) Inventors: Gregor Lenart, Taby (SE); Jens Malmgren, Cannes-la-Bocca (FR)

(73) Assignee: Cellmax Technologies AB, Taby (SE)

( * ) Notice: Subject to any disclaimer, the term of this patent is extended or adjusted under 35 U.S.C. 154(b) by 282 days.

(21) Appl. No.: 11/631,623

(22) PCT Filed: Jun. 29, 2005

(86) PCT No.: PCT/SE2005/001027

§ 371 (c)(1),
(2), (4) Date: Apr. 10, 2007

(87) PCT Pub. No.: WO2006/006913

PCT Pub. Date: Jan. 19, 2006

(65) Prior Publication Data

US 2008/0024386 A1 Jan. 31, 2008

(30) Foreign Application Priority Data

Jul. 9, 2004 (SE) ..... 0401829

(51) Int. Cl.
*H01Q 1/50* (2006.01)

(52) U.S. Cl. ..... 343/906; 343/790

(58) Field of Classification Search ..... 343/906, 343/790, 791
See application file for complete search history.

(56) References Cited

U.S. PATENT DOCUMENTS

| | | | | |
|---|---|---|---|---|
| 5,489,912 | A * | 2/1996 | Holloway | 343/749 |
| 5,621,420 | A * | 4/1997 | Benson | 343/791 |
| 5,995,053 | A * | 11/1999 | Curtis | 343/715 |
| 6,816,120 | B2 * | 11/2004 | Kuramoto | 343/702 |
| 7,283,103 | B2 * | 10/2007 | Wangsvick et al. | 343/775 |

FOREIGN PATENT DOCUMENTS

| | | |
|---|---|---|
| DE | 4329361 | 3/1995 |
| WO | WO 2004091037 | 10/2004 |

* cited by examiner

*Primary Examiner*—Tan Ho
(74) *Attorney, Agent, or Firm*—Young & Thompson

(57) ABSTRACT

An antenna (1) comprising a housing containing coaxial lines (10), where each coaxial line comprises a wall as an outer conductor (4) and a center line (2), in parallel with a reflector (3), with a connector (8) connected to the coaxial lines (10), and to antenna feeder cables and being mechanically connected to the antenna. Present invention is characterised in that the coaxial connector (8) is connected to a first end of a separate coaxial cable (7), and that the second end of the separate coaxial cable (7) is connected to the antenna coaxial line (10).

19 Claims, 2 Drawing Sheets

ANTENNA COMPROMISING A CONNECTOR ASSEMBLY

The present invention refers to an antenna connector assembly, especially an antenna connector assembly for use in communication antennas.

BACKGROUND OF THE INVENTION

A typical communications antenna consists of a number of radiating elements, a feeding network and a reflector. The purpose of the feeding network is to distribute a signal from a single connector to all radiating elements. The feeding network usually consists of controlled impedance transmission lines. The antennas need to be impedance matched to a predefined value, usually 50 ohm or 75 ohm, otherwise power fed into the antenna will be reflected back to its source instead of being radiated by the radiating elements, with poor efficiency as a result.

The signal needs to be split between the radiating elements in a transmission case, and combined from the radiating elements in a reception case, see FIG. 1. This is usually done using the same network, which is reciprocal. If the splitters/combiners consist of just one junction between 50 lines, impedance match would not be maintained, and the common port would be 25 ohm instead of 50 ohm. Therefore the splitter/combiner usually also provides an impedance transformation circuit that gives 50 ohm impedance at all three ports.

The antennas comprise coaxial lines that are parallel to a reflector, and that have connectors placed usually at an antenna bottom, with the connectors pointing in a direction parallel to the reflector. The connectors are usually attached to a bottom plate that is perpendicular to the reflector. A centre conductor is connected to a centre pin in the coaxial connector at the antenna bottom plate. This connector is used to connect a feeder.

To obtain cellular coverage at higher frequencies, antennas with higher gain without reducing the aperture excessively are required. Such antennas can be realized using large coaxial lines with air as dielectric.

Some manufacturers use coaxial lines with square cross-section tubes, as an outer conductor, together with a circular central conductor, as an inner conductor, see FIG. 2. The impedance of the line depends on the ratio between the outer conductor and the inner conductor, and what type of dielectric material that is used.

The inner conductor is suspended in square tubes using small pieces of dielectric support means for example made of polytetrafluoroethylene (PTFE). These dielectric support means are made as small as possible in order to maintain the line impedance. The necessary impedance transformation is obtained by machining the centre conductor or by other means such as increasing the size of the dielectric supports and optimizing their position.

Also losses within the antenna must be kept to a minimum in order to obtain a high system receiving sensitivity, and transmitting efficiency. Losses in the antenna are mainly due to impedance mismatch or losses in the antenna feeding network.

Antennas are sensitive to different kinds of disturbances, as described above. Another common disturbance that has to be avoided is intermodulation in the antenna. Antennas comprise different parts where all of them have to be intermodulation-free parts.

One problem is to connect the centre conductor of the coaxial line to the antenna connector. The connector that is used to connect a feeder cable to the antenna-feeding network is usually placed at the bottom of the antenna, and is usually attached to the bottom plate that is perpendicular to the coaxial lines that are inside the antenna. The centre pin is located in the connector, which is to be connected to the centre conductor in the coaxial line of the final line of the antenna. The outer signal path of the coaxial connector is typically connected to the end bottom plate made of a conducting material such as metal. The outer current then has to flow through the end bottom plate to the outer conductor of the feeding circuit coaxial lines. There are two requirements that must be fulfilled for the connection between the end bottom plate and both the coaxial connector and the antenna feeder outer conductor. One is that impedance matching must be maintained, and the second is that a junction between the end bottom plate and the reflector must not generate intermodulation when the antenna is subject to high power.

Both these requirements demand a consistent electrical connection between the end bottom plate and the reflector. Even if a correct impedance match is obtained, a bad electrical connection can generate intermodulation.

A further problem is that if the connector uses the centre pin to connect the centre conductor as described above, due to mechanical constraints, no standard connector is usually available, and hence a custom-made item must be used. Such non-standard connectors are much more expensive than standard connectors, and have longer lead times than standard ones.

One solution to bad electrical connection is to braze the end bottom plate to the reflector. The use of an electrically conductive bottom plate as support for the connector, and which also is used as coaxial outer conductor, introduces two electrical interfaces that potentially can generate intermodulation. One interface is between the connector and the bottom plate, and the second interface is between the bottom plate and the antenna coaxial line outer conductor. The disadvantage of this solution is that it is a very costly process, and that it is difficult to maintain a consistent manufacturing quality that would ensure low or no intermodulation. This does not either solve the problem of the connection between the connector and the bottom plate. This connection can also be subject to mechanical stress, which increases the risk for intermodulation.

Most antennas today use coaxial cables with a polymer dielectric such as PTFE and the problems above are avoided. However, the problem with this solution is that the lines introduce significant losses, this reducing the gain of the antenna.

SUMMARY OF THE INVENTION

The present invention thus refers to an antenna comprising a housing containing coaxial lines, where each coaxial line comprises a wall as an outer conductor and a center line, in parallel with a reflector, with a connector connected to the coaxial lines, and to antenna feeder cables and being mechanically connected to the antenna, and is characterized in that the coaxial connector is connected to a first end of a separate coaxial cable, and that the second end of the separate coaxial cable is connected to the antenna coaxial line.

BRIEF DESCRIPTION OF THE DRAWINGS

In the following the present invention is described in more detail, partly in connection with a non-limiting embodiment of the invention together with the attached drawings, where.

DETAILED DESCRIPTION OF THE PREFERRED EMBODIMENTS

Figure 2:
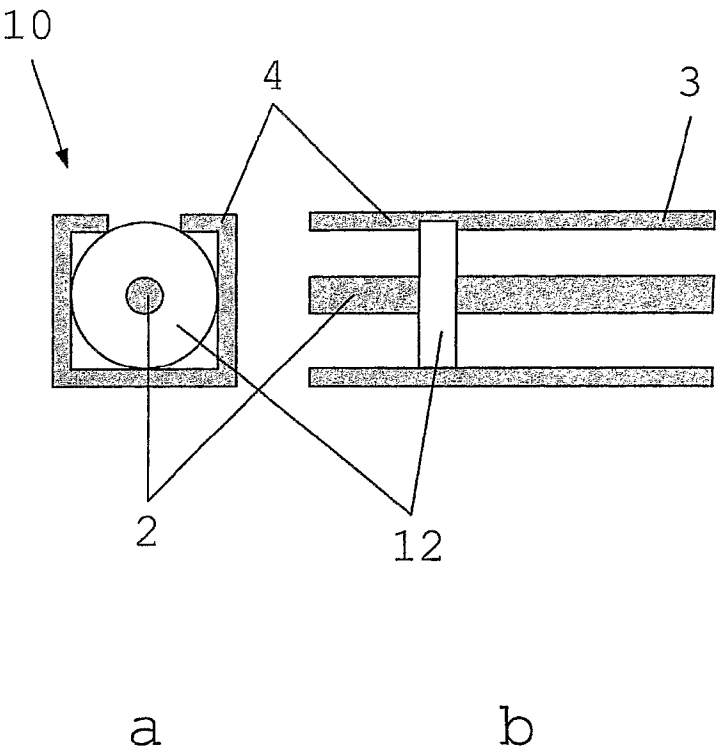
FIG. 2*a* shows a coaxial line of the present invention with an elongated opening in a cross-section view.
FIG. 2*b* shows a coaxial line of the present invention in a longitudinal section view.
Figure 1:
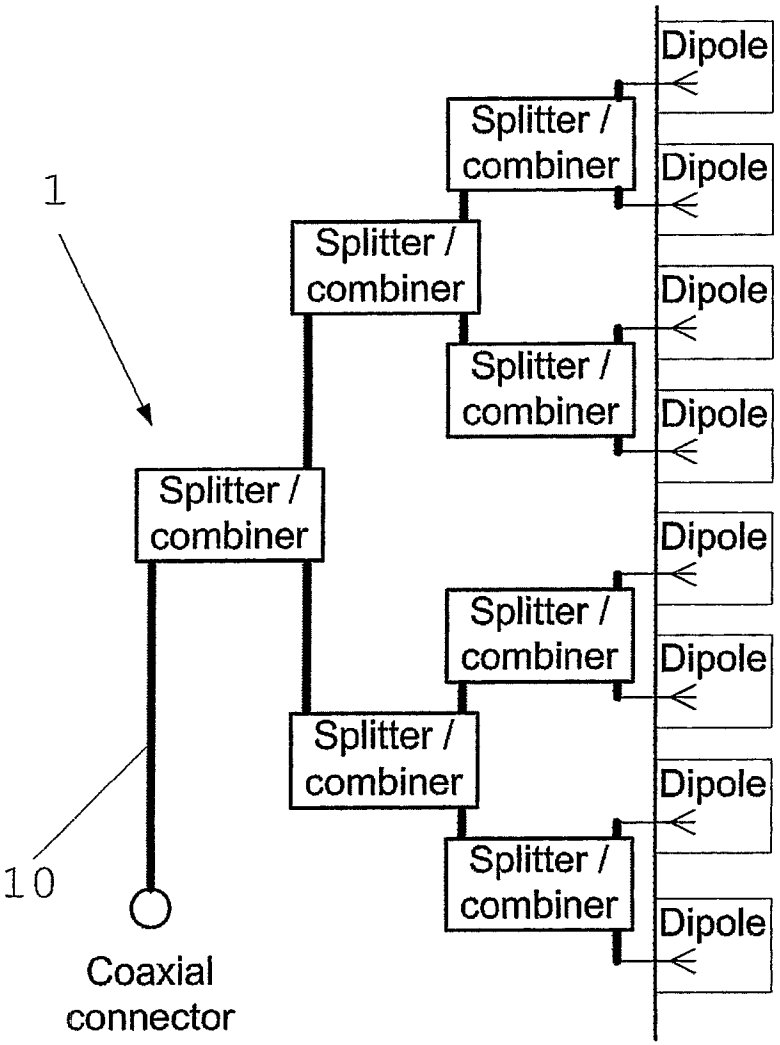
FIG. 1 shows a schematic view of the antenna feeding network.

FIG. 1 shows a typical antenna where the thicker lines represent transmission lines, also called feeding lines. These feeding lines are usually realized using coaxial lines 10. Each coaxial line 10 comprises a central inner conductor 2 and a surrounding outer conductor 4 with some kind of dielectric support means 12 in between, see FIG. 2. The material in the dielectric support means 12 could preferably be a polymer, such as PTFE.

Figure 3:
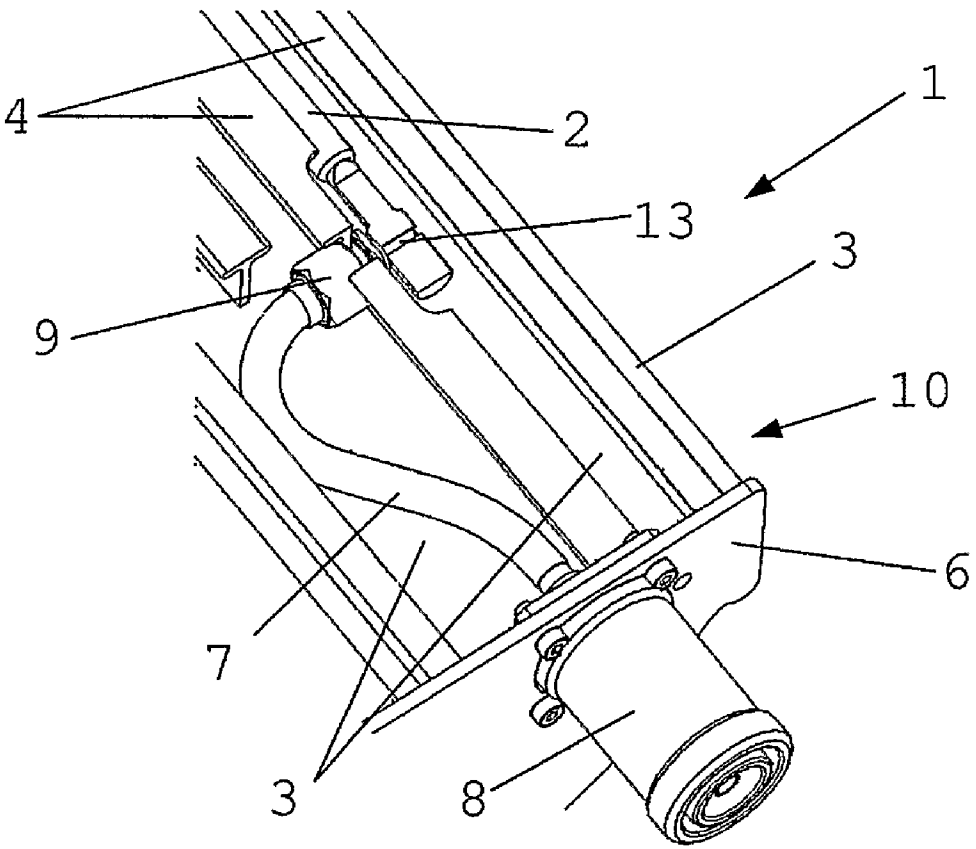
FIG. 3 shows a schematic view of the separate coaxial cable connected to the outer and the inner conductors.

A part of FIG. 3 shows an antenna 1 comprising a housing including at least one coaxial line 10, where each coaxial line comprises a wall as an outer conductor 4 and a center conductor 2 that is the inner conductor placed in the outer conductor 4 as mentioned above. The coaxial lines 10 are in parallel with a reflector 3, with a connector connected to the coaxial lines, and being mechanically attached to the antenna, and a bottom plate 6 perpendicular to the reflector 3 is attached to the same reflector 3. A connector 8 is connected to the centre conductor 2 in the antenna 1. The end bottom plate 6 serves the purpose of maintaining the connector 8 in place mechanically. Both the reflector 3 and the walls between centre conductors 2 act as the outer conductor 4. The connector 8 is connected to the coaxial line 10 in the antenna 1. The connector 8 extends outside of the end bottom plate 6.

According to the present invention the coaxial connector 8 is connected to a first end of a separate coaxial cable 7. A second end of the separate coaxial cable 7 is connected to a coaxial line 10 by connecting the separate coaxial cable 7 centre line (not shown) to the centre conductor 2 of the coaxial line 10, and by connecting the separate coaxial cable 7 outer conductor to the coaxial line 10 outer conductor 4 using a connection piece 9, where the second end of the separate coaxial cable 7, the end of the centre conductor 2 and the connection piece 9 constitute a junction, which is fully shown in FIG. 3.

The separate coaxial cable 7 that is connected to the connector 8 is provided with a bow and is connected to the outer conductor 4 and the centre conductor 2 in a substantially perpendicular way. Due to that the separate coaxial cable 7 is provided with a bow, and is connected to the centre conductor 2 in a perpendicular way, stress on the connection of the centre line of the separate coaxial cable 7, due to thermal phenomena such as length dilatation, can be eliminated. The reason is that the soldered seam in the connection will be perpendicular to possible tension direction of forces arisen due to thermal dilatation. Parts of the separate coaxial cable 7 are parallel with the antenna coaxial lines 10.

Preferably, a standard coaxial connector 8 is used with a short separate coaxial cable 7 that connects to the centre conductor 2.

The loss of cables is directly proportional to the cable lengths. The length of the coaxial cable 7 should be as short as possible to minimize the loss, while still maintaining means for taking up thermal dilatation. Preferably, the separate coaxial cable 7 is between 0-50 cm, more preferably 5-15 cm, most preferably about 10 cm.

By using this separate coaxial cable 7, the end bottom plate 6 does no longer need to be used for electrical connection between the connector 8 and the air dielectric coaxial line 10. The end bottom plate 6 could be made of a mechanically suitable conducting material, as well as made of an inexpensive non-conducting material such as polymer materials. The requirements on the properties of this end bottom plate material are now purely mechanical.

The connector 8 could be fastened to any part and place of the antenna 1, but preferably the connector 8 is mechanically fastened to the end bottom plate 6.

The coaxial cable 7 and its centre line are secured in a metal part inside the antenna 1.

In one embodiment, the outer conductor of separate coaxial cable 7 is attached and connected to the outer wall, i.e. the outer conductor 4, using the connection piece 9. The connection piece 9 consists of two parts, the first being soldered to the outer conductor of the coaxial cable 7, and incorporating a thread, the second part being a nut. In the wall of the outer conductor 4 there is a cut-out sufficient in size for the first part of the connection piece 9. The connection piece is attached and electrically connected to the outer wall 4 by tightening the second part of the connection piece 9.

In another embodiment, as mentioned above the coaxial cable 7 is straight and parallel to the coaxial lines 10 and the reflector 3.

In yet another embodiment, the coaxial cable 7 is parallel with the coaxial lines 10, but includes a double bend that allows for thermal dilatation.

A groove 13 perpendicular to the longitudinal direction is cut in the centre conductor 2 to place the centre line of the separate coaxial cable 7 in the groove 13. The centre line of the separate coaxial cable 7 placed in the groove 13 is preferably soldered to the centre conductor 2.

Due to the fact that the separate coaxial cable 7 is perpendicular to the centre conductor 2 at the connection point, currents will travel in a non-optimal way, and it is difficult to obtain a good impedance match. Therefore, a conductive lid covering the junction can be used to overcome this problem. The lid can either have galvanic contact with the outer conductor 4, or it can be isolated from the outer conductor 4 and thereby use capacitive coupling to the outer conductor 4. The conductive lid allows the currents to travel in a direction other than parallel to the coaxial lines, thus improving the impedance matching of the junction.

Above, embodiments of an antenna connector assembly have been described. However, the present invention can be used in any configuration of antenna connector assembly where an antenna connector assembly can be compensated for by an intermodulation-free connection according to the invention.

Thus, the present invention shall not be deemed restricted to any specific embodiment, but can be varied within the scope of the claims.

The invention claimed is:

1. An antenna (1), comprising:

an antenna housing containing coaxial lines (10), wherein each coaxial line (10) comprises a wall as an outer conductor (4), and a center conductor (2) in parallel with a reflector (3), with a coaxial connector (8) connected to the coaxial lines (10), connectable to antenna feeder cables and mechanically attached to the antenna, and wherein the coaxial connector (8) is connected to a first end of a separate coaxial cable (7), and that a second end of the separate coaxial cable (7) is connected to the antenna coaxial line (10).

2. The antenna (1) according to claim 1, wherein the separate coaxial cable (7) is provided with a bow and is connected to the antenna coaxial line (10) and the center conductor (2) in a substantially perpendicular way.

3. The antenna (1) according to claim 2, wherein the connection between the separate coaxial cable (7) and the coaxial line (10) is inside the antenna housing.

4. The antenna (1) according to claim 2, wherein the coaxial connector (8) is fastened to the antenna housing.

5. The antenna (1) according to claim 2, wherein the coaxial connector (8) is fastened in a bottom plate (6) of the antenna (1).

6. The antenna (1) according to claim 1, wherein the separate coaxial cable (7) is parallel with the coaxial lines (10) over at least a portion of a length of the separate coaxial cable (7).

7. The antenna (1) according to claim 6, wherein the connection between the separate coaxial cable (7) and the coaxial line (10) and is inside the antenna housing.

8. The antenna (1) according to claim 6, wherein the coaxial connector (8) is fastened to the antenna housing.

9. The antenna (1) according to claim 6, wherein the coaxial connector (8) is fastened in a bottom plate (6) of the antenna (1).

10. The antenna (1) according to claim 1, wherein the connection between the separate coaxial cable (7) and the coaxial line (10) is inside the antenna housing.

11. The antenna (1) according to claim 1, wherein a length of the separate coaxial cable (7) is between 0-50 cm.

12. The antenna (1) according to claim 1, wherein the coaxial connector (8) is fastened to the antenna housing.

13. The antenna (1) according to claim 1, wherein the coaxial connector (8) is fastened in a bottom plate (6) of the antenna (1).

14. The antenna (1) according to claim 1, wherein the outer conductor of the separate coaxial cable (7) is secured in and connected to a metal part inside the antenna housing.

15. The antenna (1) according to claim 1, wherein the outer conductor of the separate coaxial cable (7) is secured in, and electrically connected to, a cut-out in the wall of the coaxial line (10) outer conductor (4) inside the antenna (1).

16. The antenna (1) according to claim 1, wherein a conductive lid is placed above a junction formed by the separate coaxial cable (7) and the coaxial line (10).

17. The antenna (1) according to claim 16, wherein the conductive lid is in electrical contact with the coaxial line (10) outer conductor (4).

18. The antenna (1) according to claim 17, wherein the conductive lid is galvanically isolated from the coaxial line (10) outer conductor (4).

19. The antenna (1) according to claim 16, wherein the conductive lid is galvanically isolated from the coaxial line (10) outer conductor (4).

* * * * *